United States Patent [19]

Horky et al.

[11] 3,941,638

[45] Mar. 2, 1976

[54] MANUFACTURED RELIEF-SCULPTURED SOUND GRILLS (USED FOR COVERING THE SOUND PRODUCING SIDE AND/OR FRONT OF MOST MANUFACTURED SOUND SPEAKER ENCLOSURES) AND THE MANUFACTURING PROCESS FOR THE SAID GRILLS

[76] Inventors: Reginald Patrick Horky, 1729 Arizona; Scott Octave Frost, 2510 Thom St., both of Flint, Mich. 48506

[22] Filed: Sept. 18, 1974

[21] Appl. No.: 506,949

[52] U.S. Cl. ..... 156/196; 156/245; 156/267; 156/313; 156/314; 181/199; 427/358; 427/381; 427/394; 428/13

[51] Int. Cl.[2] ..... B31F 1/00

[58] Field of Search ..... 181/143–160, 181/199; 156/196, 245, 267, 313, 314; 427/358, 381, 394; 428/13

[56] References Cited

UNITED STATES PATENTS

| | | | |
|---|---|---|---|
| 1,965,830 | 7/1934 | Hammer | 181/199 |
| 2,885,024 | 5/1959 | Jordan | 181/199 |
| 2,938,113 | 5/1960 | Schnell et al. | 325/352 |
| 3,160,225 | 12/1964 | Sechrist | 181/151 |
| 3,666,610 | 5/1972 | Rosen | 181/157 |

*Primary Examiner*—William A. Powell
*Assistant Examiner*—Brian J. Leitten
*Attorney, Agent, or Firm*—Gifford, Chandler & Sheridan

[57] ABSTRACT

A method for constructing a relief sculptured sound grill comprising the steps of soaking a strip of flexible material in a starch solution and thereafter securing the flexible material between a male and female mold member so that the mold members form the desired relief sculpture on the flexible material. The strip of material is then dried and paint is applied to the relief sculpture and dried thereby permanently forming the relief sculpture on the strip of material. A frame is then secured around the periphery of the strip of material and the mold members are removed so that a hardener may be applied to the entire strip of material. The strip of material with the attached frame is then dried thus completing the relief sculptured sound grill of the present invention.

5 Claims, 6 Drawing Figures

MANUFACTURED RELIEF-SCULPTURED SOUND GRILLS (USED FOR COVERING THE SOUND PRODUCING SIDE AND/OR FRONT OF MOST MANUFACTURED SOUND SPEAKER ENCLOSURES) AND THE MANUFACTURING PROCESS FOR THE SAID GRILLS

BACKGROUND OF THE INVENTION

1. Field of the Invention

The present invention relates generally to a method of constructing a relieved sculptured sound grill.

2. Description of the Prior Art

Sound grills adapted to cover an acoustical speaker cabinet typically serve two distinct purposes. First the sound grill protects the relatively delicate speaker components within the speaker from damage. Secondly, the sound grill provides an aesthetically pleasing appearance to the speaker cabinet.

In one type of sound grill, a three-dimensional pattern is formed on the speaker grill for aesthetic purposes. This type of sound grill, known in the art as a relief sculptured sound grill, has become quite popular in modern times and enjoyed widespread public acceptance primarily due to the infinitely variable number of different designs which can be formed on the sound grill. Such relief sculptured sound grills, however, have been heretofore relatively expensive to manufacture thereby necessarily increasing the overall cost of the speaker.

SUMMARY OF THE PRESENT INVENTION

The present invention overcomes the above mentioned disadvantage of the previously known relief sculptured sound grills by providing a method whereby a relief sculptured sound grill may be formed from a relatively inexpensive strip of material, such as burlap. The method of the present invention comprises the steps of soaking a strip of flexible material in a starch solution and thereafter clamping the strip of material between a male and female mold member so that the mold members form the desired relief sculpture on the strip of flexible material. A frame is then attached around the outer periphery of the strip of flexible material, thus forming the sound grill, and the sound grill is then dried.

After the sound grill has completely dried, the relief sculpture is painted and the sound grill with the still attached mold members is again dried thereby permanently forming a relief sculpture on the strip of flexible material.

After the relief sculpture has completely dried, the mold members are removed from the sound grill and a clear hardener, such as lacquer, is applied to the entire strip of the material. The sound grill again is dried and excessive material is removed from around the outer periphery of the sound grill frame and the relief sculptured sound grill of the present invention is complete.

BRIEF DESCRIPTION OF THE DRAWINGS

The method of the present invention will be more clearly understood by reference to the following detailed description when read in conjunction with the accompanying drawing wherein like reference characters refer to like parts throughout the several views and in which.

DETAILED DESCRIPTION OF THE PRESENT INVENTION

Figure 1:
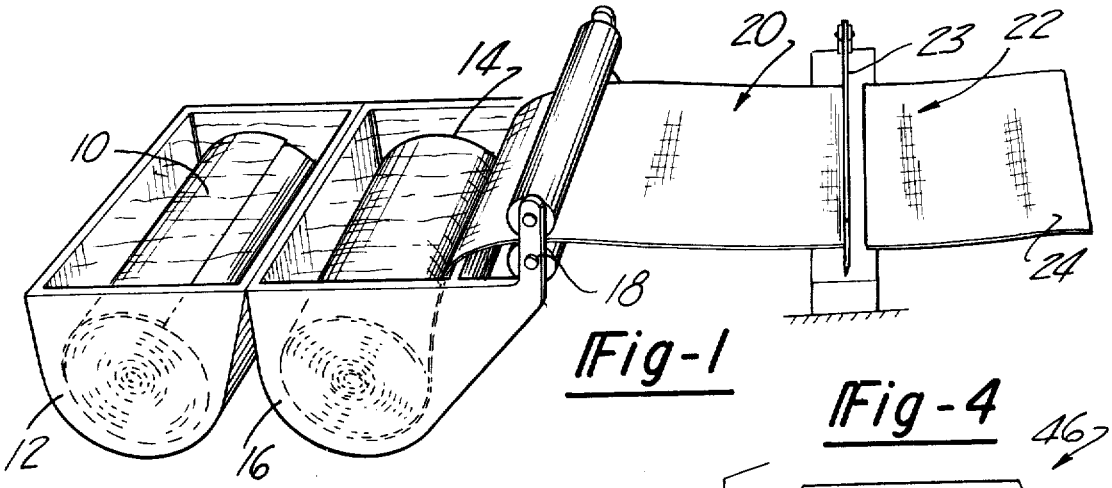
FIG. 1 is a perspective view showing the flexible material soaking in a starch solution.

Referring first to FIG. 1 a first roll of flexible material 10 is shown soaking in a first vat 12 and a second roll of flexible material 14 is shown soaking in a second vat 16. The first vat 12 contains a heavy starch water solution and functions primarily as a storer and pre-soaker for the roll of flexible material 10. The flexible material 10 is preferrably a webbed matting material, such as burlap, and in addition has the qualities of sound transparency, porosity for soaking, some tensile strength, and flexibility upon drying after soaking. In addition, the flexible material 10 preferrably is capable of withstanding heat up to 250°F without disintegration or brittleness in order to permit artificial drying.

The second vat 16 also contains a starch water solution which may include a dye, and preferrably includes a pair of cooperating rollers 18 through which a band 20 of flexible material 14 may be drawn. As the band 20 of flexible material 14 is drawn through the roller 18, the rollers 18 serve to remove excess starch water solution from the band 20 of flexible material 14 and return this excess to the vat 16. A cutting unit 22, such as a cutter blade 23, is positioned exteriorly of the vats 12 and 16 and functions to cut a small strip of material 24 from the band 20.

Figure 2:
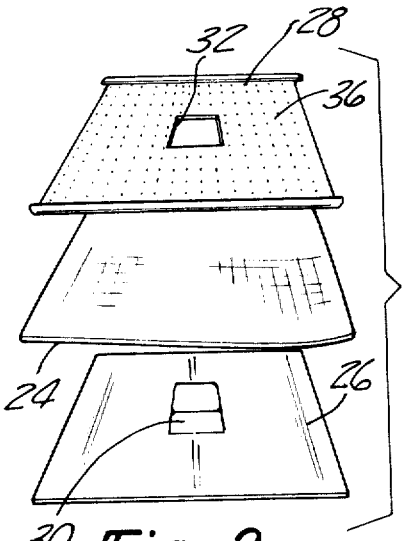
FIG. 2 is an exploded perspective view showing a strip of the flexible material between the male and female mold members.
Figure 3:
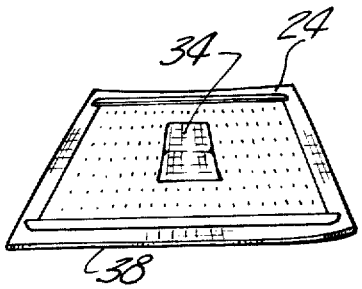
FIG. 3 is a perspective view showing the mold members assembled to the strip of flexible material.

Referring now to FIGS. 2 and 3, the strip of flexible material 24 is placed intermediate a male mold member 26 and a female mold member 28. The male mold member 26 includes a relief expression 30 adapted to register with and be received through an aperture 32 formed in the female mold member 28 so that when the mold members 26 and 28 are clamped together, a relief sculpture 34 will be formed in the strip of flexible material 24 roughly corresponding to the relief expression 30. It will be understood that the relief sculpture 34 and relief expression 30 shown in the drawing are very simple for ease of description. However, more complete and multiple relief sculptures 34 may be formed on the strip of flexible material 24 without deviating from either the spirit of scope of the present invention.

The aperture 32 in the female mold member 28 is preferrably undersized so that when the mold members 26 and 28 are clamped together, the mold members will be retained together. In addition the female mold member preferrably includes a plurality of relatively small apertures 36 to enhance the drying of the strip of flexible material 24. Lastly the strip of flexible material 24 is dimensioned somewhat larger than the mold members 26 and 28 so that an overlap 38 of flexible material is provided around the periphery of the mold members 26 and 28.

Figure 4:
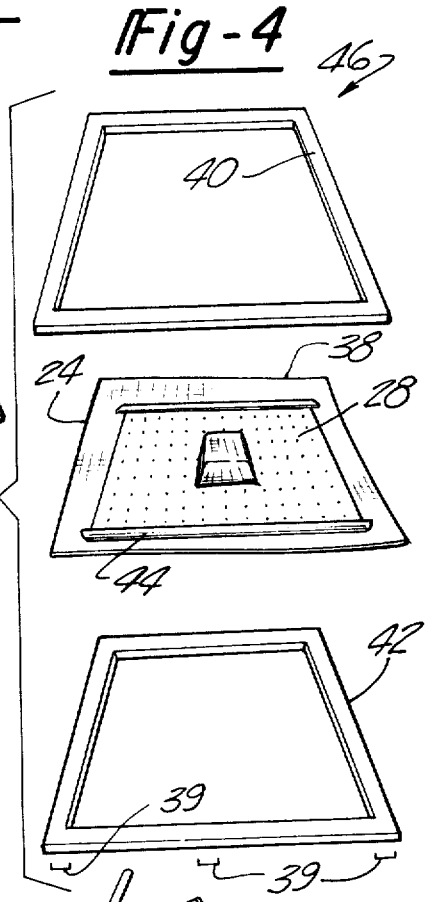
FIG. 4 is an exploded perspective view showing the attachment of a frame to the strip of flexible material.

Referring now to FIG. 4 generally rectangular frame members 40 and 42 are secured to the overly 38 of flexible material, preferrably by utilizing the rims 44 of the mold members 26 and 28, as guides. The frame members 40 and 42 may be secured to the overlay 38, and hence to each other, by any conventional means, such as glue, staples 39, or the like. The frame members 40 and 42 in conjunction with the strip of flexible material 24 form an acoustical speaker sound grill 46. The sound grill 46 is then removed to a drying room (not shown) where the starch water solution is dried.

Figure 5:
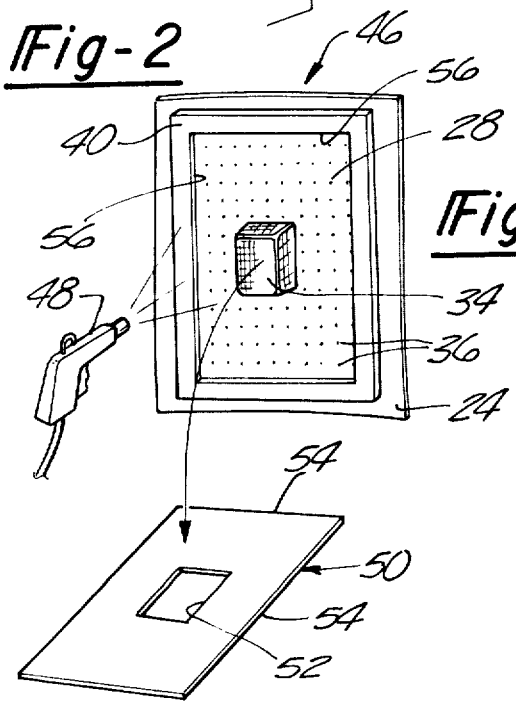
FIG. 5 is a perspective view showing one painting operation for the method of the present invention.

Referring now to FIG. 5, after the starch water solution has completely dried, a hardener, such as lacquer paint at a ratio of one ounce of lacquer to 25 square inches of sound grill area, is applied to the relief sculpture 34 on the sound grill 46. The relief sculpture 34 may be coated with the hardener in any conventional fashion, but preferrably a spray gun 48 is utilized to provide an even application of the hardener. In addition in order to prevent the hardener from entering the apertures 36, a template 50 having an aperture 52 adapted to receive the relief sculpture 34 therethrough, is placed over the sound grill 46 so that only the desired areas of the sound grill 46 are coated. In the illustration shown in FIG. 5 the template 50 includes edges 54 which fit within the inner rims 56 of the frame member 40 so that the relief sculpture 34 and the frame member 40 may be simultaneously coated.

After the hardener is applied to the relief sculpture 34, the sound grill 46 is again dried, preferrably in a heated drying room, so that after drying, the relief sculpture 34 is permanently formed on the strip of flexible material 24. Since the relief sculpture 34 is permanently formed on the strip of material 24, the mold members 26 and 28 can be, and are, removed. With the mold members 26 and 28 removed, a preferrably clear hardener, such as lacquer, is applied to the entire sound grill 46. Again for eveness of application, a spray gun is utilized to apply the hardener and in practice it has been found that six liquid ounces of hardener are required for approximately six square feet of the sound grill surface area.

Figure 6:
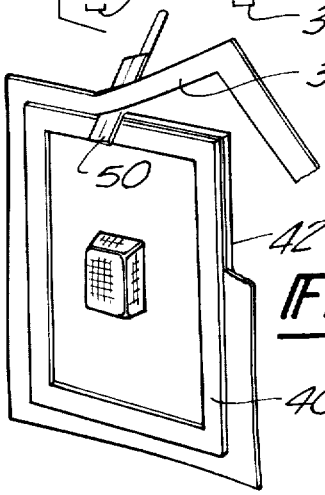
FIG. 6 is a front plan view showing the removal of the excess material from the frame.

The sound grill 46 is then again dried, preferrably in a heated drying room so that after the sound grill has dried the relief sculpture 34 is permanently formed on the sound grill 46 and the remaining area of the sound grill 46 is relatively rigid due to the hardener. The excess overlay 38 of material is then removed, as shown in FIG. 6, by a knife 50 or the like from around the outer periphery of the frame members 40 and 42 thereby completing the construction of the sound grill 46.

It can thus be seen that the present invention provides a novel method of constructing a relief sculptured sound grill from a strip of relatively inexpensive material. It will be understood that the method of the present invention may be readily adapted to produce virtually any design or relief sculpture or sculptures on the strip of flexible material by simply substituting mold members with a different design.

Having thus described my invention many modifications thereto will become apparent to persons skilled in the art to which it pertains without deviating from the spirit of the invention as defined by the scope of the appended claims.

We claim:

1. A method of constructing a relief sculptured sound grill comprising:

the first step of soaking a strip of flexible material in a starch solution, the second step of placing said strip of flexible material between a male mold member and a female mold member, said male mold member and female mold member cooperating to form a relief sculpture on said strip of flexible material, the third step of drying said strip of flexible material, the fourth step of applying a hardener to said relief sculpture, the fifth step of drying said strip of flexible material, the sixth step of removing said mold members, the seventh step of applying a hardener to said strip of flexible material, and the last step of drying said flexible material.

2. The method as defined in claim 1 and further comprising the step of attaching a frame around the outer periphery of said strip of flexible material after said second step.

3. The method as defined in claim 2 wherein said frame comprises two cooperating frame members and said step of attaching the frame further comprises glueing the strip of flexible material between the cooperating frame members.

4. The method as defined in claim 3 and including the further step of removing excess material from around the outer periphery of the frame members.

5. The method as defined in claim 2 wherein said frame comprises two cooperating frame members and said step of attaching a frame further comprises stapling the strip of flexible material between the cooperating frame members.

* * * * *

UNITED STATES PATENT OFFICE

CERTIFICATE OF CORRECTION

PATENT NO. : 3,941,638

DATED : March 2, 1976

INVENTOR(S) : Reginald Patrick Horky et al

It is certified that error appears in the above-identified patent and that said Letters Patent are hereby corrected as shown below:

Col. 1, line14, delete "acoustical" and insert --accoustical--.

Col. 2, line 21, 25, 29, 55, 58, and 67, delete "preferrably" and insert --preferably--.

Col. 2, line 66, delete "overly" and insert --overlay--.

Col. 3, line 5, delete "acoustical" and insert --accoustical--.

Col. 3, lines 14, 27, 33 and 34, and 40, delete "preferrably" and insert --preferably--.

Col. 3, line 35, delete "eveness" and insert --evenness--.

Signed and Sealed this

*first* Day of *June 1976*

[SEAL]

*Attest:*

RUTH C. MASON
*Attesting Officer*

C. MARSHALL DANN
*Commissioner of Patents and Trademarks*